United States Patent [19]

Mori et al.

[11] Patent Number: 4,510,648

[45] Date of Patent: Apr. 16, 1985

[54] WEIGHTING DEVICE FOR DRAFTING MEANS

[75] Inventors: Mitsuo Mori, Toyota; Yoshihisa Suzuki, Chiryu; Shigeru Muramatsu, Okazaki; Sigeru Takasu, Kariya, all of Japan

[73] Assignee: Kabushiki Kaisha Toyoda Jidoshokki Seisakusho, Kariya, Japan

[21] Appl. No.: 513,410

[22] Filed: Jul. 14, 1983

[30] Foreign Application Priority Data

Jul. 15, 1982 [JP] Japan ..... 57-122166

[51] Int. Cl.[3] ..... D01H 5/52

[52] U.S. Cl. ..... 19/266; 19/272; 19/295

[58] Field of Search ..... 19/266, 267, 268, 272, 19/295; 57/81, 87

[56] References Cited

U.S. PATENT DOCUMENTS

| | | | |
|---|---|---|---|
| 2,971,226 | 2/1961 | Eggenschwyler | 19/272 |
| 3,143,772 | 8/1964 | Whitehurst | 19/272 |
| 4,187,587 | 2/1980 | Vignon | 19/272 |

FOREIGN PATENT DOCUMENTS

| | | | |
|---|---|---|---|
| 1228538 | 11/1966 | Fed. Rep. of Germany | 19/272 |
| 693252 | 6/1953 | United Kingdom | 19/272 |

*Primary Examiner*—Louis K. Rimrodt

*Attorney, Agent, or Firm*—Burgess, Ryan & Wayne

[57] ABSTRACT

A novel weighting device for draft rollers, in which a diaphragm is provided, as a pressing unit, above each top side roller. The diaphragms provided on a spinning frame are classified into a plurality of groups corresponding to species of rollers such as front rollers, middle rollers, and back rollers. Each group of diaphragms has common piping having a regulator for air pressure and branched to the diaphragms belonging to the group. One end of the piping is connected to a common high pressure air source, from which air of a uniform pressure controlled by the regulator is supplied to the diaphragms belonging to the group. Since a weighting force onto a top side roller is a function of a air pressure supplied to the diaphragm, it can be changed or diminished at once in a centralized manner by adjusting the regulator. Therefore, troublesome adjustment of individual pressing units is unnecessary.

3 Claims, 4 Drawing Figures

WEIGHTING DEVICE FOR DRAFTING MEANS

BACKGROUND OF THE INVENTION

1. Field of the Invention

This invention relates to a drafting means for a textile machine, especially for a spinning frame. More specifically, it relates to a weighting device for top rollers of a drafting means, in which a fiber bundle is drafted between two successive pairs of top and bottom rollers.

2. Description of the Prior Art

There are two types of roller weighting device in conventional systems; a dead weight type and a spring loaded type. The former is inconvenient in handling and lacks a damping effect against vibration. The latter is better on the abovesaid points, however, cannot easily maintain a uniform weighting force on all of the rollers arranged throughout the frame. Since dimensional differences between rollers cannot be avoided due to inherent manufacturing error or abrasion during usage, the spring force on the rollers varies unless the displacement of the spring is adjusted individually.

In addition, these two conventional devices have the common drawback of a troublesome adjustment. That is, to change the load on the rollers, e.g., when changing the draft ratio, adjustment or replacement of the weights or springs for the rollers is necessary.

In fasciated yarn spinning, in which yarn can be produced at a high rate 10 times faster than by ring spinning, the accuracy and uniformity of the roller weighting is particularly important, having a much more serious effect on the quality of the resultant yarn and yarn breakages during spinning than in the case of conventional ring spinning.

SUMMARY OF THE INVENTION

It is an object of the present invention to provide a roller weighting device ensuring a constant uniform pressure on all of the rollers belonging to a spinning frame, which device is easy to adjust or unload.

The object of the present invention can be achieved by a weighting device for a drafting means of a textile machine such as a spinning frame, having a plurality of spinning units, the drafting means being a plurality of pairs of a bottom side roller and a top side roller, comprising a plurality of pressing unit exerting weighting force onto the top side roller, each of which unit is provided above each pair of rollers, wherein the pressing unit comprises a loading means utilizing fluid pressure.

BRIEF DESCRIPTION OF DRAWINGS

The present invention will now be explained in detail with reference to the accompanying drawings, wherein.

DESCRIPTION OF THE PREFERRED EMBODIMENT

Figure 1:
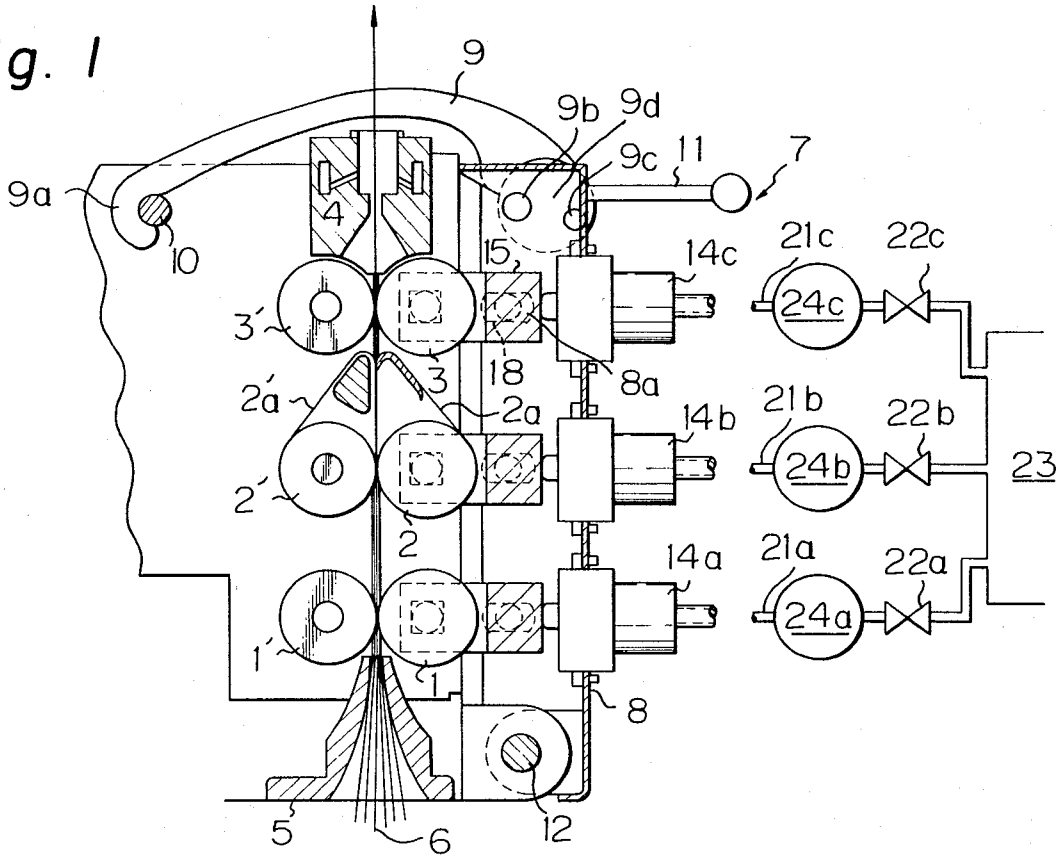
FIG. 1 is a partially sectional side view of an embodiment of the present invention.
Figure 2:
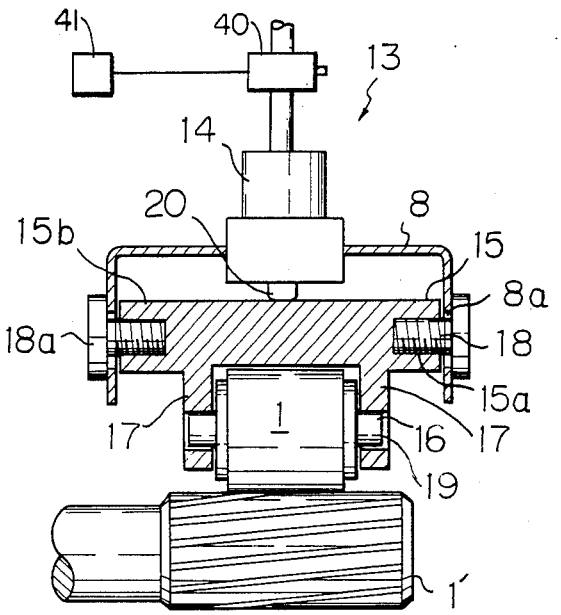
FIG. 2 is a partially sectional front view of a weighting unit of the embodiment shown in FIG. 1.

In an embodiment illustrated in FIGS. 1 and 2, a drafting means is constituted by a pair of back rollers 1,1', a pair of middle rollers 2,2' around which aprons 2*a*,2*a'* are wrapped, and a pair of front rollers 3,3'. A sliver 6 supplied through a collector 5 is attenuated by the three pairs of rollers and is introduced into an air nozzle 4, in which it is twisted to a fasciated yarn. The above-mentioned reference numerals 1, 2, and 3 designate top side rollers, and the numberals 1', 2', and 3' designate bottom side rollers. The bottom side rollers 1', 2', and 3' are disposed on roller stands (not shown) fixed on a frame and are engaged with a driving mechanism (not shown). The top side rollers 1, 2, and 3 can be pressed onto the corresponding bottom side rollers, respectively, by means of a weighting device 7 according to the present invention, provided above the top side rollers (i.e., in the right in FIG. 1).

The weighting device 7 comprises three pressing units 13 secured on a weighting arm 8, the units 13 corresponding to the top side rollers 1, 2, 3. The weighting device 7 can take two positions; a locked position and a released position. In the locked position, the device 7 is disposed on the draft rollers so that the pressing units 13 can be urged thereto. The position is locked by the engagement of a hook 9*a* of a lever 9 with a pin 10 fixed on the frame. In this arrangement, the lever 9 is rotatably pivoted around a pin 9*c*, which is mounted on a common cylindrical member 9*d* with a pin 9*b*. In turn, the cylindrical member 9*d* is mounted on the arm 8 by the pin 9*b*.

For the released position, in the case, for example, of roller replacement, a handle 11 is operated counterclockwise, which is secured on the cylindrical member 9*d* so that handle 11 is pivotable around the pin 9*b*. This causes the same directional rotation of the pin 9*b* around another pin 9*c* provided between the handle 11 and the pin 9*b*, whereby the lever 9 is moved to the left in FIG. 1, causing disengagement of the hook 9*a* from the pin 10. This allows the top side rollers 1, 2, and 3 together with the pressing units 13 to be parted from the bottom side rollers 1', 2', and 3' by pivoting the arm 8 clockwise around a pin 12.

Each pressing unit 13 comprises, as shown in FIG. 2, a diaphragm 14 and a roller holder 15, both of which are secured on the weighting arm 8. The roller holder 15 has a pair of laterally projected portions on both sides of which threaded bores 15*a* are axially provided. The holder 15 is mounted on the weighting arm 8 in such a manner that the holder 15 is disposed inside of the U-shaped cross-section of the arm 8 and is loosely engaged with elongated holes 8*a* provided in the opposite side walls of the arm 8 by bolts 18 screwed into the bores 15*a* through the holes 8*a*.

Since there is a clearance between a head 18*a* of the bolt 18 and the outer side of the projected portion and since the diameter of the head 18*a* of bolt 18 is larger than that of the hole 8*a*, the holder 15 can be supported within the arm 8 while allowing up and down movement along the length of the hole 8*a*.

Further, the holder 15 has a pair of fork-like legs 17 extending toward the rollers, engageable to an arbor 16 of the top side roller 1 with a slot 19.

The diaphragm 14 is secured on a top wall of the arm 8 and penetrates therethrough causing a piston rod 20 built-in in the diaphragm 14 to contact the top wall 15*b* of the holder 15. According to this structure, in the locked position of the weighting device 7, the piston rod 20 can press the top side roller 1 onto the bottom side roller 1' through the roller holder 15 when the diaphragm 14 operates.

In a textile machine such as a spinning frame, a plurality of drafting means corresponding to the plurality of spindles or spinning units is provided. In the prior art, the roller weighting devices were controllable only individually, not overall or in a centralized manner. According to the present invention, the weighting devices are classified into three groups, corresponding to the back rollers, the middle rollers, and the front rollers arranged on the spinning frame. Each group of weighting devices has a piping system for commonly supplying pressurized air to the diaphragms of the group. That is, in FIG. 1, diaphragms 14*a* corresponding to back rollers 1,1′ are all connected to a pipe 21*a*. In a similar way, diaphragm, 14*b* and 14*c*, corresponding to the middle rollers 2,2′ and the front rollers 3,3′, respectively, are connected to pipes 21*b* and 21*c*, respectively. These pipes 21*a*, 21*b*, and 21*c* are further connected to a common pressurized air source 23 through regulators 22*a*, 22*b*, and 22*c*, respectively. In FIG. 1, reference numerals 24*a*, 24*b*, and 24*c* indicate pressure gauges.

Figure 3A:
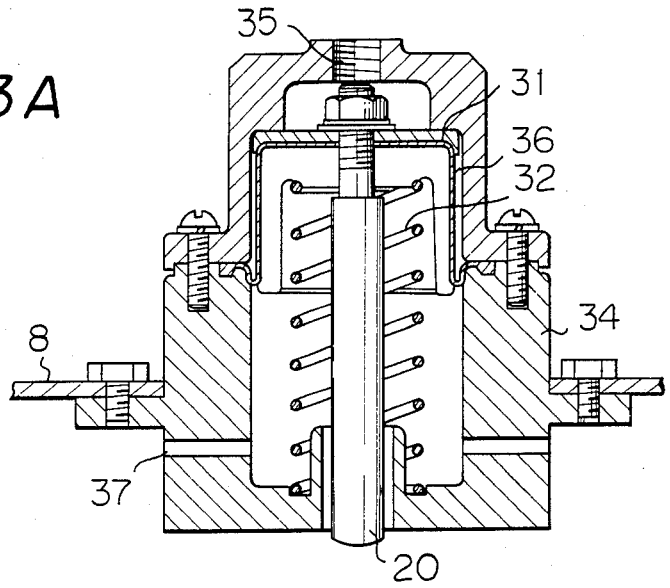
FIGS. 3A and 3B are sectional side views of a diaphragm utilized for the present invention showing the operations thereof.
Figure 3B:
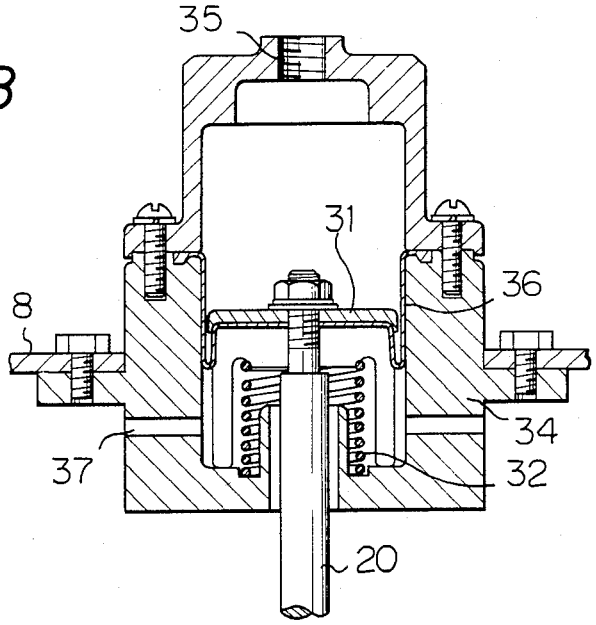

The diaphragm 14 has the structure illustrated in FIG. 3A. Within a cylinder 34, a piston 31 and a piston rod 20 secured to the piston 31 are provided. The inner pressure of the cylinder 34 is developed by high pressure air introduced thereinto through an inlet opening 35. Since the upper portion of the cylinder 34 is airtightened by means of a membrane 36, the piston 31 is displaced downward against a spring 32 provided between the piston 31 and the bottom wall of the cylinder 34, as shown in FIG. 3B. The Young's modulus of the spring 32 is selected to be as small as possible but still able to hold the weight of the piston 31 and the piston rod 20. Therefore, a uniform force is transmitted through the piston rod 20, which force is a function of only the air pressure introduced into the cylinder and is not affected by the extent of the displacement of the piston rod 20. In FIGS. 3A and 3B, reference numeral 37 designates an air outlet.

According to the above-mentioned construction of the weighting device, after being locked in the locked position as shown in FIG. 1, the top side rollers belonging to each of the three groups are pressed onto the bottom side rollers at uniform forces by the introduction of air from the source 23 each controlled by the regulators 22*a* 22*b*, or 22*c* to desirable pressures. This uniform force on the rollers in each of the groups enables an effective nipping action and an even drafting operation on the slivers to be attenuated throughout the spinning frame.

To change the weighting force on the rollers to correspond to the changes of the spinning conditions, such as the draft ratio or sliver count or to seek a better spinning condition of less yarn breakage, fine adjustment can be easily effected by the regulators 22*a*, 22*b*, and 22*c* while watching the gauges 24*a*, 24*b*, and 24*c*.

Moreover, according to the present invention, it is very easy to release the load on the rollers by deflating the diaphragms during machine stoppage, thus avoiding deformation of the rollers.

Further, even if there are differences of parts sizes due to manufacturing error or abrasion during usage between rollers or pressing units, the weighting force on the rollers can be maintained at a constant value because of the principle of fluid statics adopted in the invention.

In addition, the above-mentioned weighting device may comprise an automatic valve 40 in the piping of each pressing unit, which valve is electrically connected to a yarn sensor 41 belonging to each spinning unit. In this device, the air supplied to the specific pressing unit can be shut by the action of the automatic valve when the sensor detects yarn breakage of the spinning unit. This causes stoppage of the sliver supply into the drafting means as the release of weighting force on the rollers almost completely eliminates the nipping effect of the rollers for the sliver.

In this regard, prior art spinning frames have had a mechanical or electrical clutch connected to a yarn sensor corresponding to each spinning unit for disengaging only the back rollers from the driving means. When the clutch operates by a yarn breakage signal from the sensor, the sliver is torn between the back rollers and the middle rollers. Thus, the sliver supply is stopped while the middle and the front rollers continue to rotate. According to the prior art, the sliver in the drafting means has to be attenuated again by the middle rollers and the front rollers when the spinning operation restarts. This causes instability of drafting and deterioration of yarn quality. Also, the provision of a clutch results in higher manufacturing cost as well as a lower reliability.

The diaphragm utilized for the embodiment of the present invention may be replaced by a similar means using fluid pressure such as air or oil.

As described above, according to the present invention, a uniform roller weighting force can be assured throughout the spinning frame and a level change of the force and adjustment thereof can be easily carried out in a centralized manner, which enhances yarn quality and machine productivity.

We claim:

1. A weighting device for a drafting means of a textile machine such as a spinning frame having a plurality of spinning units, said drafting means being a plurality of pairs of a bottom side roller and a top side roller, comprising a plurality of pressing units exerting weighting force onto said top side roller, each of which units is provided above each said pair of rollers, wherein said pressing unit comprises a loading means utilizing fluid pressure wherein said pressing units are classified into at least two groups according to positions of said pairs of rollers to which said pressing unit engages and wherein each group of said pressing units, at least in one textile machine, is provided with common piping for supplying fluid of uniform pressure to branches extending to said pressing units belonging to said group and wherein each of said branches has an automatic valve operatively connected to a yarn sensor of each of said spinning units whereby the pressure to the pressing units can be released in response breakage of the yarn.

2. A weighting device according to claim 1, wherein said loading means is a diaphragm.

3. A weighting device according to claim 1, wherein said loading means is a diaphragm.

* * * * *